US006622714B2

(12) United States Patent
Liang

(10) Patent No.: US 6,622,714 B2
(45) Date of Patent: Sep. 23, 2003

(54) CAP GUN WITH CONTINUOUS SHOOTING FEATURE

(76) Inventor: Guodong Liang, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/050,705

(22) Filed: Jan. 18, 2002

(65) Prior Publication Data

US 2002/0148456 A1 Oct. 17, 2002

(30) Foreign Application Priority Data

Apr. 11, 2001 (TW) ..... 90205649 U

(51) Int. Cl.[7] ..... F41B 1/00
(52) U.S. Cl. ..... 124/74; 72/73; 72/75
(58) Field of Search ..... 124/72, 73, 74, 124/75

(56) References Cited

U.S. PATENT DOCUMENTS 4,819,610 A * 4/1989 Lacam et al. ..... 124/74
4,850,330 A * 7/1989 Nagayoshi ..... 124/50
4,936,282 A * 6/1990 Dobbins et al. ..... 124/73
5,078,118 A * 1/1992 Perrone ..... 124/73
5,257,614 A * 11/1993 Sullivan ..... 124/73
5,280,778 A * 1/1994 Kotsiopoulos ..... 124/31
5,349,938 A * 9/1994 Farrell ..... 124/72
5,349,939 A * 9/1994 Perrone ..... 124/74
5,497,758 A * 3/1996 Dobbins et al. ..... 124/71
5,542,406 A * 8/1996 Oneto ..... 124/50
5,613,483 A * 3/1997 Lukas et al. ..... 124/70
5,673,679 A * 10/1997 Walters ..... 124/49
5,778,868 A * 7/1998 Shepherd ..... 124/73
5,913,303 A * 6/1999 Kotsiopoulos ..... 124/31
6,286,497 B1 * 9/2001 Levkov ..... 124/73
6,418,920 B1 * 7/2002 Marr ..... 124/73

* cited by examiner

*Primary Examiner*—Michael J. Carone
*Assistant Examiner*—Troy Chambers
(74) *Attorney, Agent, or Firm*—Troxell Law Office PLLC

(57) ABSTRACT

A continuous firing structure is provided for color bullet of a cap gun. The cap gun has a main body with a machine unit. The continuous firing structure mainly comprises a bullet barrel at one end of the main body and a through hole between the bullet barrel and the unit for the operation of a pushing cylinder and a discharge pin. The pushing cylinder and the discharge pin are used with a spring for continuous firing.

7 Claims, 5 Drawing Sheets

CAP GUN WITH CONTINUOUS SHOOTING FEATURE

BACKGROUND OF THE INVENTION (A) Field of the Invention

The present invention relates to a continuous firing structure for color bullet.

(B) Description of the Prior Art

The conventional cap gun with color bullet is fired by operating the trigger of the cap gun for intermittently shooting. The cap gun may be provided with electromagnetic valve for continuous shooting. However, the electromagnetic valve requires battery, which is inconvenient.

SUMMARY OF THE INVENTION

It is the object of the present invention to provide a continuous firing structure for color bullet.

To achieve above object, a continuous firing structure is provided for color bullet of a cap gun. The cap gun has a main body with a machine unit. The continuous firing structure mainly comprises a bullet barrel at one end of the main body and a through hole between the bullet barrel and the unit for the operation of a pushing cylinder and a discharge pin. The pushing cylinder and the discharge pin are used with a spring for continuous firing the color bullet of a cap gun.

The various objects and advantages of the present invention will be more readily understood from the following detailed description when read in conjunction with the appended drawing, in which:

DETAILED DESCRIPTION OF THE INVENTION

Figure 1:
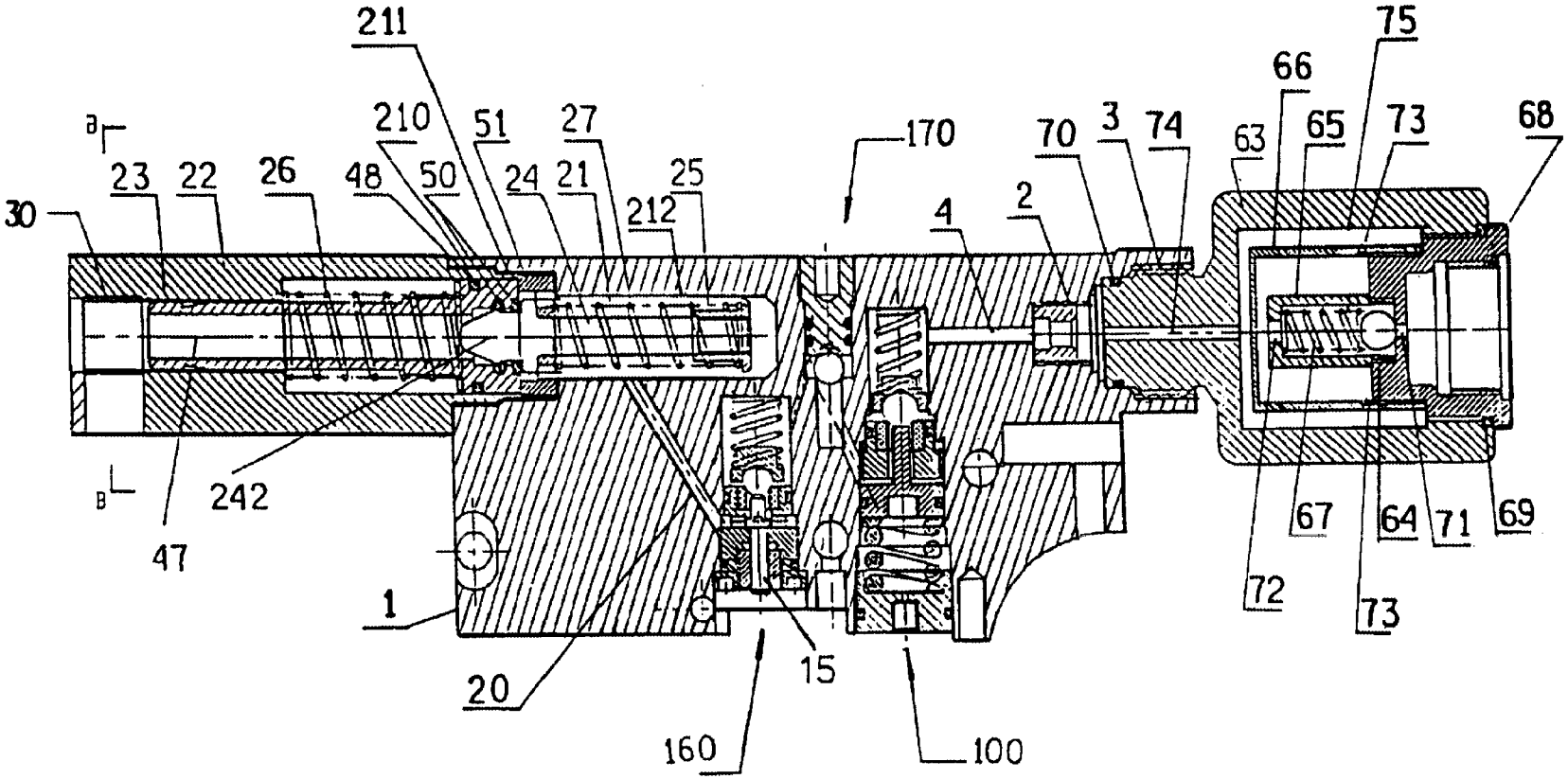
FIG. 1 shows a sectional view of the main body of the present invention.

As shown in FIG. 1, the cap gun with continuous shooting feature comprises at least one main body 1 with air conduit and a thread hole 210 near a muzzle thereof. The thread hole 210 is used to lock a bullet barrel 22. A pushing cylinder 23 and a discharge pin 24 are slidably arranged in the bullet barrel 22. The bullet barrel 22 is communicated with a switch 160 through a throttle 170 and a pressure adjuster 100 through a venting hole 20. The main body 1 has a coupling loop 63 connected to a CO2 bottle (not shown). The switch 160, the throttle 170 and the pressure adjuster 100 are well known art and will not be described in detail here. The pushing cylinder 23 is detached from the discharge pin 24 by air pressure to shoot the color bullet.

Figure 4:
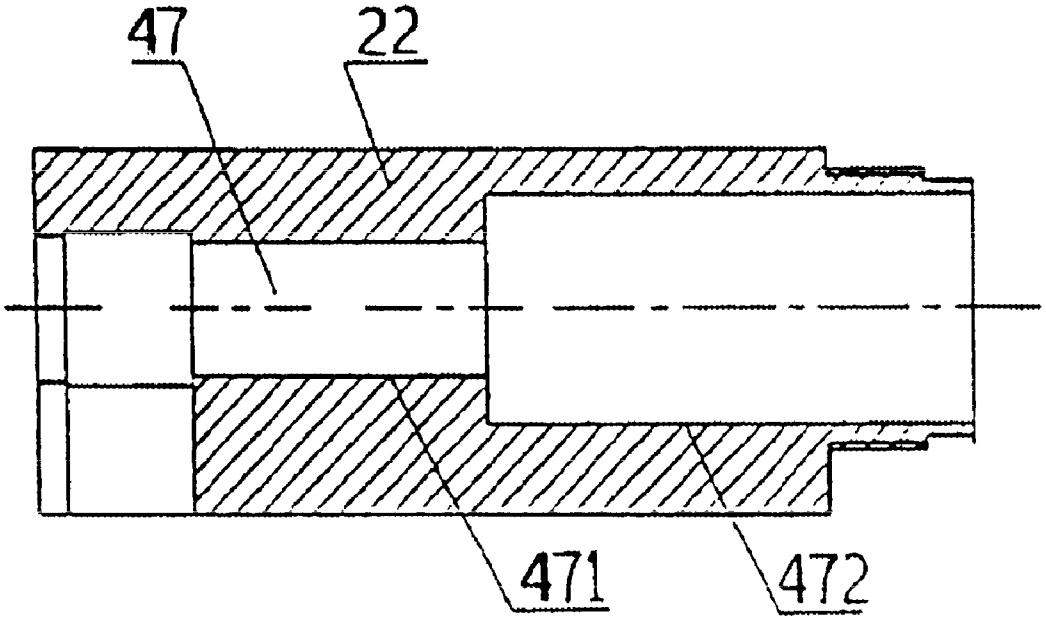
FIG. 4 shows a sectional view of the bullet barrel of the present invention.
Figure 6:
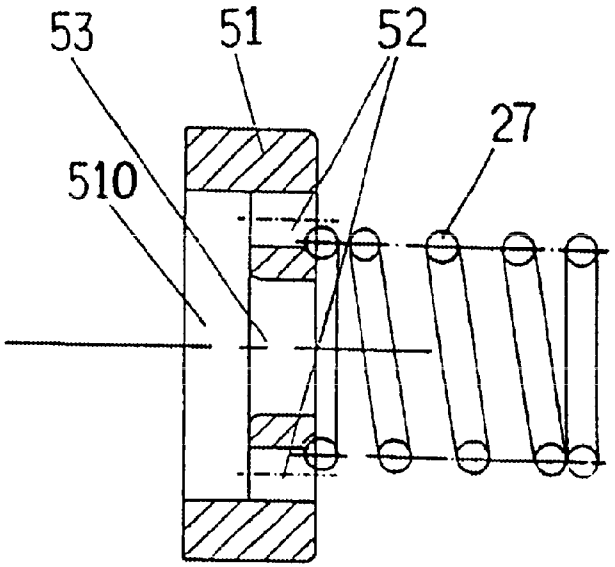
FIG. 6 shows a sectional view of the annulus washer of the present invention.
Figure 5:
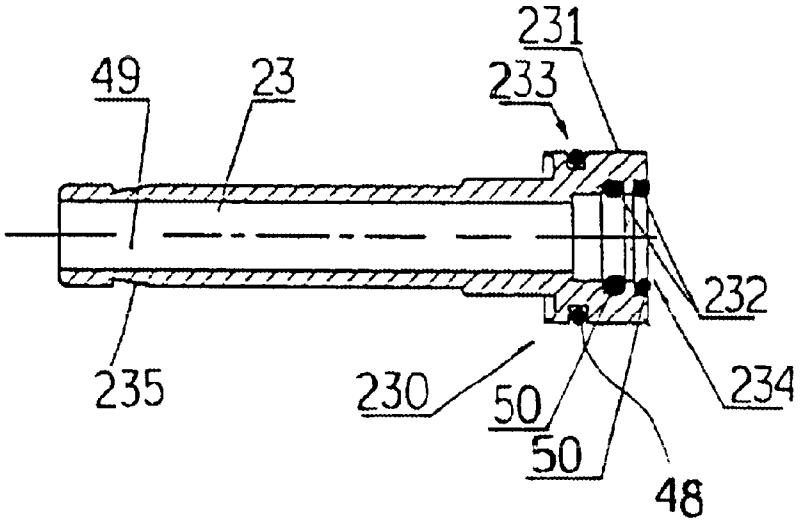
FIG. 5 shows a sectional view of the pushing cylinder of the present invention.
Figure 8:
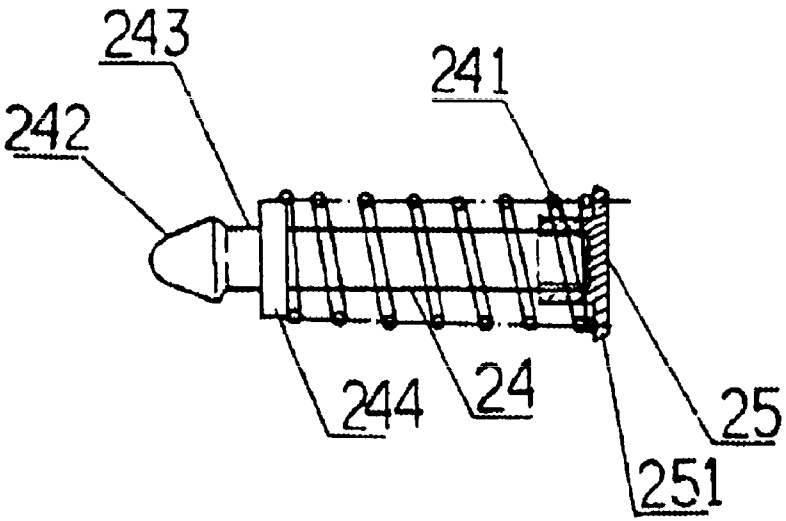
FIG. 8 shows a sectional view of the discharging pin of the present invention.
Figure 7:
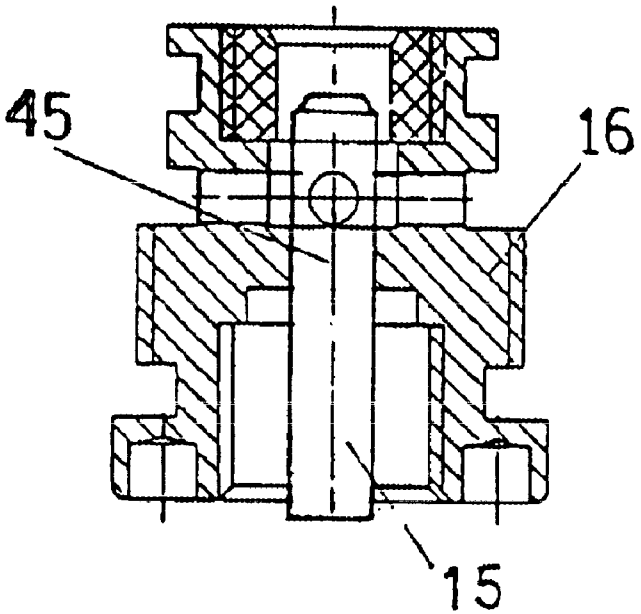
FIG. 7 shows a sectional view of the switch of the present invention.

With reference now to FIGS. 1, 4, 5, 6, and 7, the main body 1 has a stepped hole 21 at left side thereof and the thread hole 210 is at leftmost side. The stepped hole 21 contains a larger bore 211 and a small bore 212. The venting hole 20 is communicated with the smaller bore 212. The bullet barrel 22 has a center bore 47 on topside thereof and a counter bore 47A on bottom thereof and concentric with the cylinder, as shown in FIG. 4. The center bore 47 comprises a larger bore 472 on right side and a smaller bore 471 on left side. The pushing cylinder 23 has a stepped cylinder 230 on right side thereof as shown in FIG. 5 and the pushing cylinder 23 is embedded into the center bore 47. The stepped cylinder 230 has a stepped post 231 on right side thereof and covered with an embowed groove 233 to mount a sealing loop 48. The pushing cylinder 23 has a center bore 49 and the stepped post 231 has a hole 234 at center thereof. The hole 234 has two embowed grooves 232 to mount a sealing loop 50. A spring 26 is inserted therein. As shown in FIG. 6, an annulus washer 51 is provided and has a center hole 510, which has venting hole 52 communicating with a right plane. As shown in FIG. 8, the discharge pin 24 is cylindrical shape and has an outer thread 241 at right side and a cone 242 at left side. The discharge pin 24 has a recess 243 at right side of the cone 242 and a blocking ring 244 at right side of the cone 242. As shown in FIG. 1, the cone 242 of the discharge pin 24 is inserted into the hole 234 and fit with the sealing loop 50. The sealing loop 50 is matched with the blocking ring 244. As shown in FIGS. 1 and 6, the right side of the discharge pin 24 is fit with the center hole 53 of the annulus washer 15. As shown in FIG. 1, the spring 27 is fit to the right side of the discharge pin 24. As shown in FIG. 8, the pin sleeve 25 is cylinder shape and has a stopping ring 251 on right side thereof and has a center hole with inner thread. The spring 27 is fit to the outer surface of the pin sleeve 25. The inner thread of the pin sleeve 25 is screwed to the inner thread 241 of the discharge pin 24. The discharge pin 24 presses on the spring 27 so that it is abutted to the center hole 510 of the annulus washer 51, as shown in FIG. 6. The right side of the spring 27 is abutted to the stopping ring 251. The annulus washer 51 is arranged on the larger bore 211 of the main body 1. The outer thread of the bullet barrel 22 is fit into the inner thread of the many body 1 such that the right end of the bullet barrel 22 is abutted to the annular washer 51. When compressed air is fed into the stepped hole 21 and reaches a predetermined value overcoming the elasticity of the spring 26, the pushing cylinder 23 and the discharge pin 24 are moved leftward. When both ends of the spring 27 are pressed between the annulus washer 51 and the pin sleeve 25, the discharge pin 24 stops moving as the spring 27 is pressed to its limit. At this time, the pushing cylinder 23 is pushed leftward and the pushing cylinder 23 naturally detaches from the sealing loop 50. The pressed air blown off the center bore 49 of the pushing cylinder 23 to shoot the bullet. Due to the limit of the throttle 170 and the pressure adjuster 100, the pressed air is not instantly supplied. The discharge pin 24 is restored to initial state due to the tension of the spring 27, and then the pushing cylinder 23 is restored to initial state due to the tension spring 26. Therefore, the stepped hole 234 is locked to the cone 242 and sealed with the sealing loop 50 for next shooting. For continuous shooting, the user keeps his finger on the trigger and the switch 160 keeps opening, the air is supplied from a steel bottle. The pushing cylinder 23 and the discharge pin 24 are in cyclic operation for continuous shooting.

Figure 2:
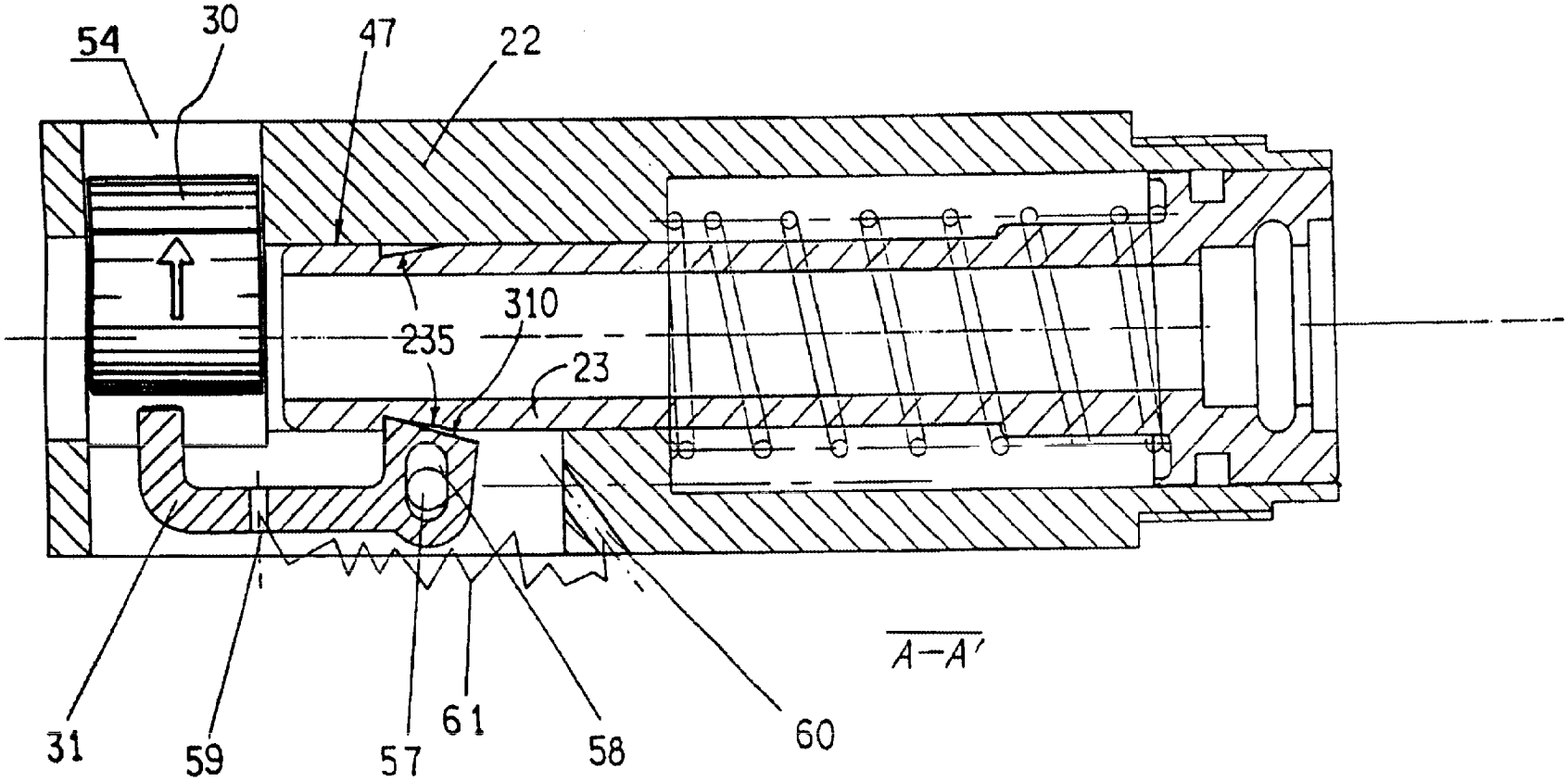
FIG. 2 shows a sectional view of the shell ejecting means of the present invention.
Figure 3:
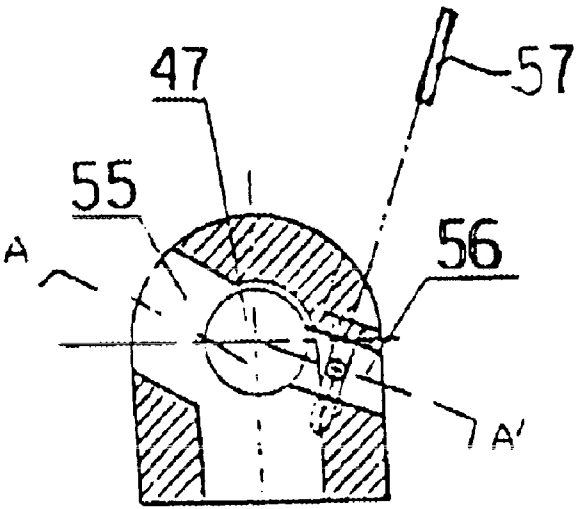
FIG. 3 shows another sectional view of the shell ejecting means of the present invention.

As shown in FIGS. 2 and 3, the bullet barrel 22 has a bullet entrance 54 at left side thereof and connected to the smaller bore 47. A slanting hole 55 for ejecting shell is provided at same location and an elongate slit 56 is opposite to the slanting hole 55. The elongate slit 56 has a cylindrical pin 57 at right side thereof. The cock 31 has a hook at left side thereof and a rectangular block at right side thereof. The rectangular block has an elliptical groove 58 at center thereof and assembled with the cylindrical pin 57. The cock 31 has a small hole 59 at center thereof and the elongate slit 56 has also a slanting hole 60 at right side thereof. The two slanting holes are connected by a draw spring 61 such that the rectangular block presses against the outer surface of the pushing cylinder 23 and the pushing cylinder 23 has a bevel 235 corresponding to the rectangular block. The cartridge 30 is of cylindrical shape and has a center bore slidably fit with the bullet. When the pushing cylinder 23 is moved leftward, the bevel 235 pushes the root 310 of the cock 31 and the elliptical groove 58 is slid along the cylindrical pin 57. At the same time, the pushing cylinder 23 pushes leftward the bullet in the cartridge 30. After the bullets are depleted, the pushing cylinder 23 rapidly restores to original position. The cartridge 30 is pushed by the cock and ejected through the slanting hole. Another cartridge 30 can be easily loaded.

As shown in FIG. 1, the main body 1 has two stair holes 2, 3 with inner thread on the rightmost ends thereof and coupling loop 63 is engaged into the inner thread. The coupling loop 63 has a two-steps post having an embowed groove fit into a sealing loop 70. The embowed groove has an outer thread and the coupling loop 63 has a large bore 75. The small post has as venting hole 74 connected with the larger bore 75. The nut 68 is of three stages with rightmost stage having a blocking ring. The other two stages of the nut 68 have inner threads of different sizes. The bore has inner thread at left end and stair hole at right end and an inner thread at rightmost end and venting hole 71 at center and connected to the inner thread and the stair hole. The spring cover 65 is of cylindrical shape and has an inner hole at right end thereof. The inner hole has a via hole 72 and an outer thread engaged with inner thread of the nut 68. The inner hole has a spring 67 and a steel ball 64. With absence of external force, the ball 64 is pushed by the spring 67 to seal the venting hole 71. The valve 66 is of cylindrical shape and has an inner hole at right end thereof and the inner hole has an inner thread engaged with the outer thread of the nut 68. A plurality of leak holes 73 is provided on left side of the inner thread. The valve 66 has a separation with the spring cover 65 and the coupling loop 63. When the nut 68 is connected to an air storage bottle, the pressed air presses the steel ball 64 and compresses the spring 67 and through the via hole 72 to strike the inner wall of the inner hole of the valve 66 to form vapor of higher purity. The vapor passes through the gap between the leak holes 73 and the coupling loop 63 and passes through the venting hole 74 and the through hole 4 to enter the main body. The sealing loops 69 and 70 are fit into the embowered groove of the coupling loop 63 and the nut 68 to seal the vapor.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A continuous firing structure for color bullet of a cap gun comprising:

a) a main body having a first end, a second end, and a circumference, the main body having a first stepped hole in the first end, a second stepped hole in the second end, a plurality of third stepped holes in the circumference, and a plurality of ventilating holes to allow compressed air to flow through the main body;

b) a bullet barrel having a first barrel end, a second barrel end, a center barrel bore from the first barrel end to the second barrel end, and a counter bore extending inwardly from the second barrel end, the second barrel end having a connecting device connecting the second barrel end to the first end of the main body;

c) a pushing cylinder having a first cylinder end, a second cylinder end, a cylinder circumference, and a cylinder center bore from the first cylinder end to the second cylinder end, the second cylinder end having a stepped post with a hole, the pushing cylinder being positioned within the center barrel bore at the second barrel end;

d) a discharge pin having a conical first pin end with a blocking ring, a second pin end, and a recess between the first pin end and the blocking ring, the discharge pin inserted into the first stepped hole of the main body, the first pin end of the discharge pin positioned against the hole of the stepped post of the pushing cylinder;

e) a compression spring positioned around a circumference of the discharge pin, the compression spring being positioned between the blocking ring and the second pin end of the discharge pin;

f) an annulus washer having a stepped center hole and a venting hole, the annulus washer positioned between the blocking ring of the discharge pin and the first stepped hole of the main body; and g) a tension spring provided on the cylinder circumference of the pushing cylinder between the counter bore of the second barrel end of the bullet barrel and the stepped post of the pushing cylinder.

2. The continuous firing structure for color bullet of a cap gun according to claim 1, further comprising a coupling loop having a first loop end, a second loop end, a spring cover, a compression spring, and a steel ball, the first loop end connected to the second end of the main body, the second loop end of the coupling loop connected to an air bottle, whereby the spring cover, the compression spring, and the steel ball form a switch between the air bottle and the main body.

3. The continuous firing structure for color bullet of a cap gun according to claim 1, further comprising a pressure adjuster in the main body.

4. The continuous firing structure for color bullet of a cap gun according to claim 1, wherein the hole in the stepped post of the pushing cylinder has a sealing loop.

5. The continuous firing structure for color bullet of a cap gun according to claim 1, wherein the pushing cylinder has a sealing loop on an outer circumference of the stepped post.

6. The continuous firing structure for color bullet of a cap gun according to claim 1, wherein the recess of the discharging pin has a sealing loop.

7. The continuous firing structure for color bullet of a cap gun according to claim 1, wherein the discharge pin includes a pin sleeve on the second pin end.

* * * * *